US006215885B1

(12) United States Patent
Geiger

(10) Patent No.: US 6,215,885 B1
(45) Date of Patent: Apr. 10, 2001

(54) AUDIO SPEAKER

(76) Inventor: George R. Geiger, 9029 Diamond Pointe Dr., Indianapolis, IN (US) 46236

( * ) Notice: Subject to any disclaimer, the term of this patent is extended or adjusted under 35 U.S.C. 154(b) by 0 days.

(21) Appl. No.: 08/882,992

(22) Filed: Jun. 26, 1997

(51) Int. Cl.[7] ..... H04R 25/00

(52) U.S. Cl. ..... 381/386; 381/345; 381/391; 181/224

(58) Field of Search ..... 381/337, 338, 381/339, 340, 345, 347, 391, 189, 87, 342, 386, FOR 151, FOR 165, 397, 71.3, 71.5, 71.7, 165; 181/150, 141, 199, 224, 206

(56) References Cited

U.S. PATENT DOCUMENTS

| | | | | |
|---|---|---|---|---|
| D. 255,234 | | 6/1980 | Wellward et al. | D14/30 |
| 4,296,280 | | 10/1981 | Richie | 179/1 |
| 4,331,841 | * | 5/1982 | Castagna | 381/391 |
| 4,640,381 | | 2/1987 | Tsuchiya et al. | 181/144 |
| 4,903,300 | | 2/1990 | Polk | 381/24 |
| 4,918,738 | * | 4/1990 | Bader | 381/391 |
| 5,082,083 | | 1/1992 | Draffen | 181/150 |
| 5,113,968 | | 5/1992 | Lemmon | 181/148 |
| 5,460,570 | * | 10/1995 | Okamura et al. | 181/224 |
| 5,828,759 | * | 10/1998 | Everingham | 381/71.5 |

* cited by examiner

*Primary Examiner*—Huyen Le
(74) *Attorney, Agent, or Firm*—Slaughter & Rosenberg; Marshall E. Rosenberg

(57) ABSTRACT

An audio speaker is incorporated in a ventilation register having a front grill through which sound generated by the audio speaker is projected, and a back plate to which the audio speaker is secured, spaced apart from the front grill by side plates to form an enclosure adapted to be received in registration with the ventilation duct. The back plate includes at least one and preferably a plurality of ventilation slots offset from and surrounding the audio speaker for communicating an air flow between the front grill and the back plate of the speaker arrangement, thereby allowing for the unimpeded operation of the ventilation system. So as to provide thermal protection for sensitive components of the audio speaker, thermal barrier is installed over the rearward extending speaker components to thermally isolate those components from conditioned, heated and cooled air either being flowed into or out of the room.

4 Claims, 3 Drawing Sheets

AUDIO SPEAKER

FIELD OF THE INVENTION

This invention is directed generally to acoustic devices, and more particularly to an audio speaker such as an audio speaker to be incorporated in an air handling system as an element of an audio speaker system.

BACKGROUND OF THE INVENTION

Acoustic devices such as audio speakers, also known as loudspeakers, are well known and widely used for transmitting audio output to and within a designated listening environment within earshot of an audience to be accommodated within that environment. However, walls and partitions, doors, windows, furniture, and fixtures often present structural and aesthetic challenges when selecting a preferred placement of conventional audio speakers which are typically housed in box-like structures. It is a widely acknowledged problem in the relevant art that such conventional box speakers, which are typically provided in single or plural pairings, are undesirably large and bulky and thus hinder unobtrusive yet acoustically correct placement in any of the various rooms of a residential dwelling, such as a bedroom, study, or playroom. Moreover, desired, optimal placement of box speakers in a living room or other typically larger area of the residential dwelling to effect a desired stereo effect is often compromised when placement of furniture within the room is strongly suggested by various features of the room itself, including window and door installations within the room. Accordingly, the conventional approach to placement of audio speakers is generally compromised by the very features often provided in a selected room for the comfort and convenience of a listener.

Another well-known approach that has been only partially successful in addressing and overcoming these prior art problems is the installation of audio speakers within the walls of a room, generally between adjacent walls studs of the room, such that the exterior surface of the mounted speaker appears to be flush with or minimally protruding from the wall. In-wall mounted speakers include U.S. Pat. Nos. 5,113,968; 5,082,083; 4,903,300; 4,640,381; and 4,296,280. Such installations require exact measurements, leveling, framing and costly drywall repairs, which must generally be provided as custom work in view of the generally non-standard, large variety of available speaker sizes and arrangements within the wall-based enclosure. Another fundamental problem with this approach is that, in order to achieve optimal listening positions within the room in which such speakers are installed, furniture placement is essentially limited to a region within a defined listening area, which is generally considered to be the phase-matched cone-shaped region defined by overlapping audio distributions of each of the pair of stereo audio speakers facing the listener. As a result, yet another fundamental problem with this approach is essentially total inflexibility of such system to be positionally adjusted without an additional, costly custom reinstallation of one or both of each pair of in-wall mounted speakers to accommodate a changed floor plan of furniture, whereby placement of couches, chairs and the like will be dictated by the fixed placement of the in-wall mounted speakers. Such inflexibility may also negatively impact desired decoration of the room.

Furthermore, whether the speakers are independently box-mounted or wall-mounted, they must be powered and operated at sufficiently high volume levels to be heard clearly by a listener who is often located a distance from the speakers and often on the opposite side of the room. As will be appreciated, such sound volume requirements may result in undesired disturbances in adjacent rooms or levels of the building. Moreover, speaker wires often present logistical and aesthetic problems in the overall positioning of the speakers and furniture in the room.

Accordingly, there is a need for an audio speaker which is particularly suitable for flexible installation in a low-visibility profile, yet which provides enhanced listening characteristics at relatively low volume and power levels.

SUMMARY OF THE INVENTION

The audio speaker of the present invention overcomes these and other disadvantages of the related art by providing an audio speaker which is supported by, and concealed within, a ventilation register common to most forced air ventilation systems. According to a preferred embodiment of the invention, the audio speaker is secured to a ventilation register having a front grill through which sound generated by the audio speaker is projected, a back plate spaced apart from the front grill by side plates to form an enclosure adapted to be received in registration with the ventilation duct, and means for conducting a signal to the audio speaker. According to one embodiment of the invention, the audio speaker is secured by an outermost flange of the speaker cone in registration with a recess formed in the back plate, to direct sound generated by the audio speaker through the recess in the general direction of the front grill. In addition, a front trim plate extending from the front grill and secured by the side plates, supportingly engages in overlapping relationship the speaker arrangement with a facing structure through which the speaker arrangement extends, such facing structures including floors, baseboards, walls and ceilings.

According to an embodiment of the invention, the back plate includes at least one and preferably a plurality of ventilation slots offset from and surrounding the audio speaker for communicating an air flow between the environment to be conditioned and the ventilation duct through the front grill and the back plate of the speaker arrangement, thereby allowing for the unimpeded operation of the ventilation system. Accordingly, the ventilation register functions as a conditioned air distribution vent and/or an air return vent. So as to provide thermal protection for sensitive components of the audio speaker especially when operating in the air distribution mode, an insulating means such as a cup-shaped or cone-shaped thermal barrier is installed over and encloses the rearward extending speaker components extending from the rear surface of the back plate to thermally isolate those components from conditioned, heated and cooled air either being flowed into or out of the room through the ventilation slots formed in the back plate.

In addition, a speaker signal may be transmitted to the speaker either by a wired connection with a remotely located signal source, or by a remote transmitter transmitting audio signals to be received by a radio receiver positioned adjacent the audio speaker for receiving a signal from a remotely located signal source. In the latter embodiment, the radio receiver and a d.c. power source are contained either within the forward-opening cavity of the ventilation register or secured to the back plate of the register to maintain a compact assembly configured to be installed without alteration to the supporting structure or the ductwork thereby also effectively eliminating unsightly speaker wires, while providing additional speaker positioning opportunities. In addition, a volume control and/or power control may be positioned adjacent the audio speaker, either within the forward-opening cavity of the ventilation register or separately installed through the trim plate of the register. Furthermore, so as to achieve the desired low visibility profile of the present invention and/or to maintain a consistent or distributed appearance, the audio speaker of the present invention may be installed in a ductless recess formed in a ventilation register-supporting structure, such as a floor, baseboard, wall, or ceiling to replicate a pseudo ventilation duct, in the absence of an air flow duct, whether operational or not. Alternatively, the apparatus of the invention may be installed in a plurality of such pseudo duct recesses where no true ducted system is present. According to the invention, a single or plural numbers of audio speakers, including tweeters and mid-range speakers are contemplated for use within the generally compact dimensions of most ventilation registers

DETAILED DESCRIPTION OF THE PREFERRED EMBODIMENTS

Figure 1:
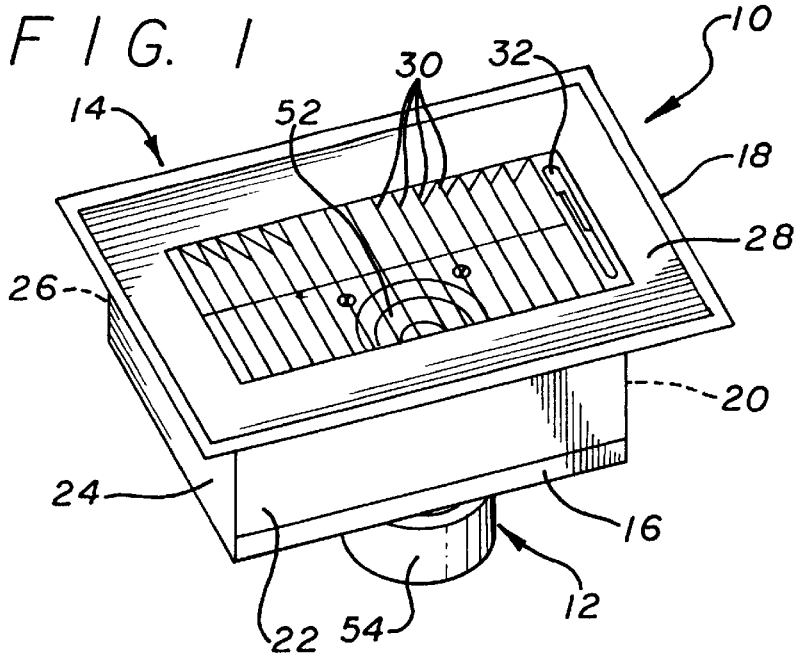
FIG. 1 is a perspective view of the audio speaker of the present invention, incorporated into a ventilation register according to one embodiment of the present invention, in which the audio speaker is secured to the floor of the cavity of the register for projecting sound though the face of the register.
Figure 2:
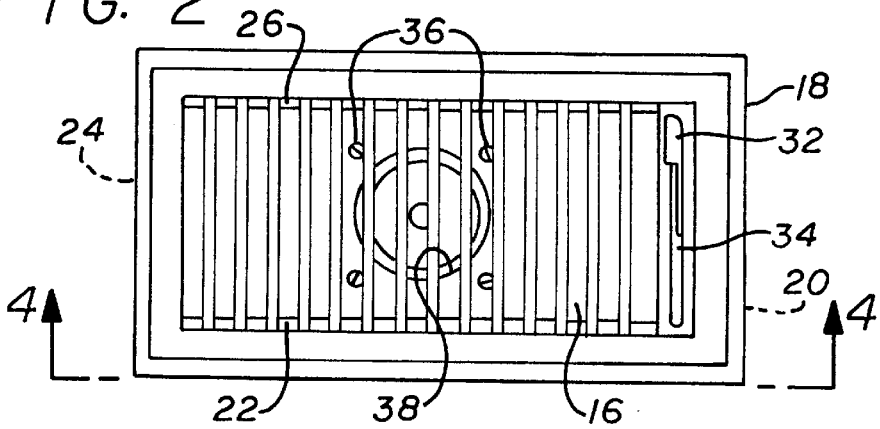
FIG. 2 is a top plan view of the audio speaker of FIG. 1, showing a single audio speaker centrally secured within the ventilation register.

Referring now in detail to the drawings wherein like parts are designated by like reference numerals throughout, there is illustrated in FIGS. 1–5 a first embodiment of the audio speaker arrangement of the present invention which is designated generally by reference numeral 10. The audio speaker arrangement includes an audio speaker 12 secured to a ventilation register mounting means 14, and includes a back plate 16 spaced apart from a front face 18 by side plates 20, 22, 24, 26 to form an enclosure adapted to be received in registration with a terminus of a ventilation duct (not shown). The ventilation register 14 further comprises a front trim plate 28 integrally formed with the front face 18 and incorporates a plurality of angularly adjustable louvers 30 operated by a louver control lever 32 acting through a shuttle control 34 (FIG. 2) to reposition as desired a louver-adjusting mechanism (not shown). According to the invention, the back plate 16 is secured to the bottom edges of side plates 20, 22, 24, 26 for supporting the audio speaker 12 by a plurality of fasteners 36 in concentric registration with an opening 38 formed in the back plate 16. The back plate 16 is fabricated of a phenolic or fiberglass construction known to damp undesirable harmonics, and to also maintain dimensional tolerances when it is exposed on a continuing, long-term basis to heating and cooling thermal stresses. With the exception of the non-metallic back plate 16, the balance of the register is conventionally fabricated from sheet metal such as sheet steel and aluminum painted with an anti-corrosive finish. Alternatively, the entirety of the ventilation register 14 may be fabricated in a unitary structure, or bifurcated with the back plate and housing portions fabricated of a polymeric material having good structural rigidity and high thermal resistance to sag, creep and relatively low temperature fracture.

Figure 3:
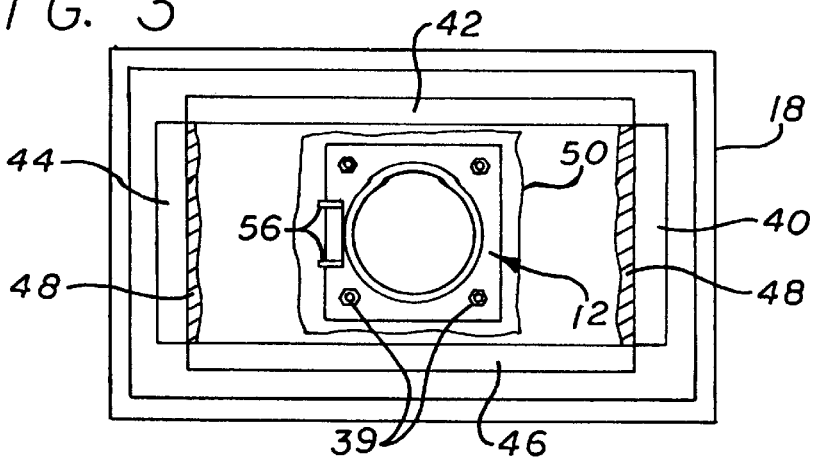
FIG. 3 is a bottom plan view of the audio speaker of FIG. 1, showing the rearwardly extending portions of the speaker mounted to the back plate of the ventilation register.
Figure 4:
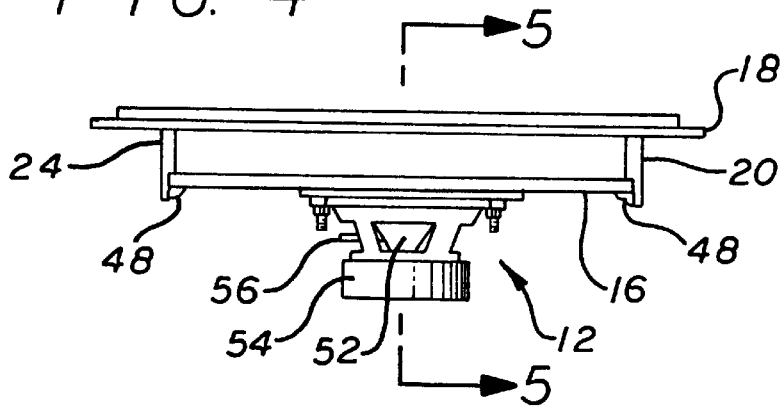
FIG. 4 is a vertical sectional view taken along plane 4—4 of FIG. 2.
Figure 5:
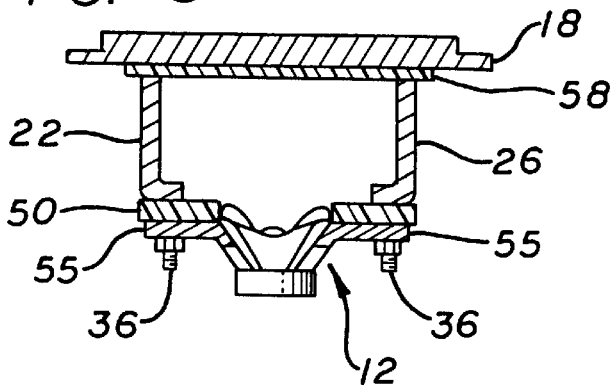
FIG. 5 is a vertical sectional view taken along plane 5—5 of FIG. 4, showing the internal component arrangement of the audio speaker of FIGS. 1–4.

Referring now to FIGS. 3–5, ventilation register 14 commonly available for air handling applications is generally fabricated with four sidewalls 40, 42, 44, 46, shaped to form the side plates 20, 22, 24, 26, respectively, in cantilevered fashion by extending from the underside of the front face 18. The back plate 16 of the present invention is fitted into close juxtaposition with the side plates, and two beads 48 of a predominantly inert sealant, such as a silicon-based sealant, are then applied to the junctions of the back plate 16 and side plates 20, 24 to fully seal the enclosure. It will be appreciated that the ventilation register 14 have a rectangular or square cross-section when constructed in this manner, or a round, oval or otherwise irregular cross-section having one or more curvilinear sidewalls securing the front face 18 to the back 16. In this condition, audio speaker 12 is mounted to the back plate 16 with fasteners 36, such as screws, rivets or the like which extend through a flange of the speaker 12 to be secured thereto with appropriate fastening hardware 39. A sealing membrane 50 such as a conforming gasket or another bead of sealant may be provided between the flange of the audio speaker 12 and the opposing underside of the back plate 16 to reduce or eliminate transmission of vibrations between the audio speaker arrangement 10 and the wall/floor/duct in which the arrangement 10 is installed.

Figure 8:
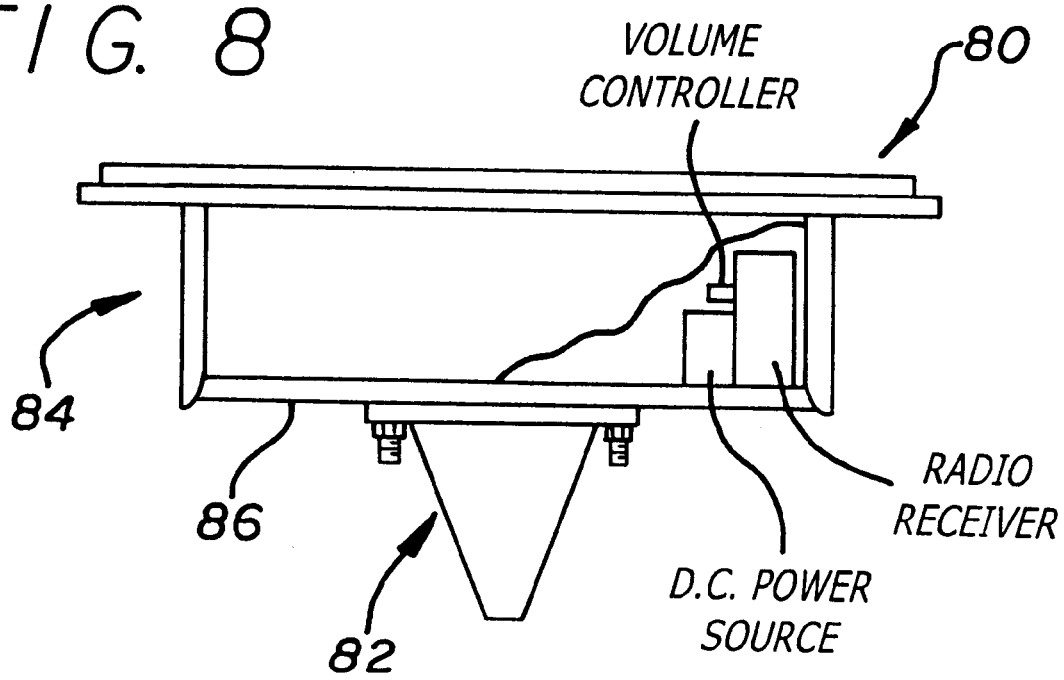
FIG. 8 is a vertical sectional view, partly broken, of another embodiment of the present invention, showing a radio receiver and d.c. power source contained within the ventilation register of a wireless audio speaker arrangement.

Audio speaker 12, which may be a tweeter, mid-range speaker, or woofer, includes a speaker cone 52, a magnet 54, and additional electronic components such as a voice coil, and possibly baffles, horns and dividing networks for coupling the driving electric circuit and the electrocoustic transducer (not shown) supported by a sheet metal cage 55 are operatively connected to speaker leads 56 for connection to a remotely-located audio signal source. Alternatively, and with reference to another embodiment shown in FIG. 8, which will be more fully discussed below, the invention is further directed to a remote transmitter transmitting audio signals to be received by a radio receiver positioned proximate the audio speaker for receiving a signal from a remotely located signal source. It is further contemplated by the present invention that non-cone type transducers, such as linear transducers, may be used with the apparatus 10, and in that configuration, would provide an even more compact audio speaker arrangement.

As previously described, the invention is directed to providing a low profile speaker appearance by essentially concealing the audio speaker 12 from readily apparent view. Accordingly, a further feature of the invention is an acoustically transparent concealment screen 58 positioned within the register cavity between the front face 18 and the back plate 16, and preferably directly beneath the front face 18.

Figure 6:
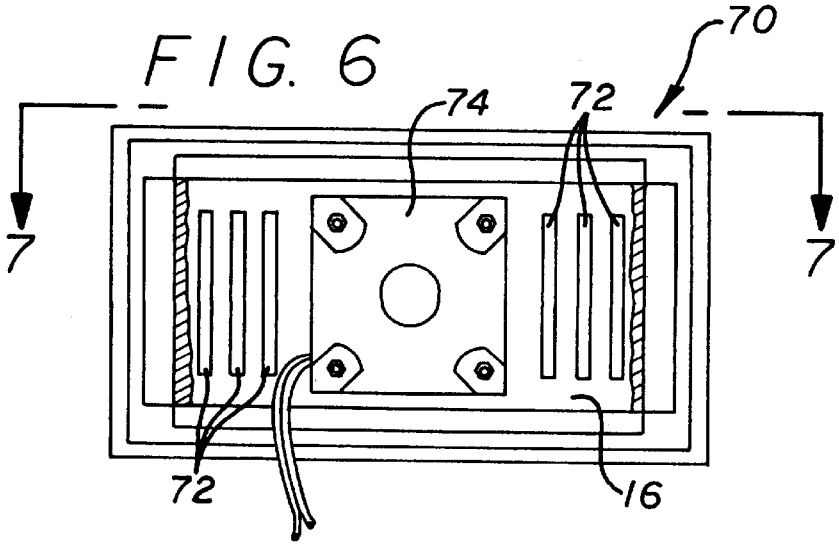
FIG. 6 is a bottom plan view of another embodiment of the audio speaker of the present invention, showing a thermal insulating cup encompassing the totality of the rearwardly extending portions of the audio speaker, and a plurality of ventilation slots formed in the back plate of the register offset from the audio speaker to enable airflow through the audio speaker arrangement of the invention.
Figure 7:
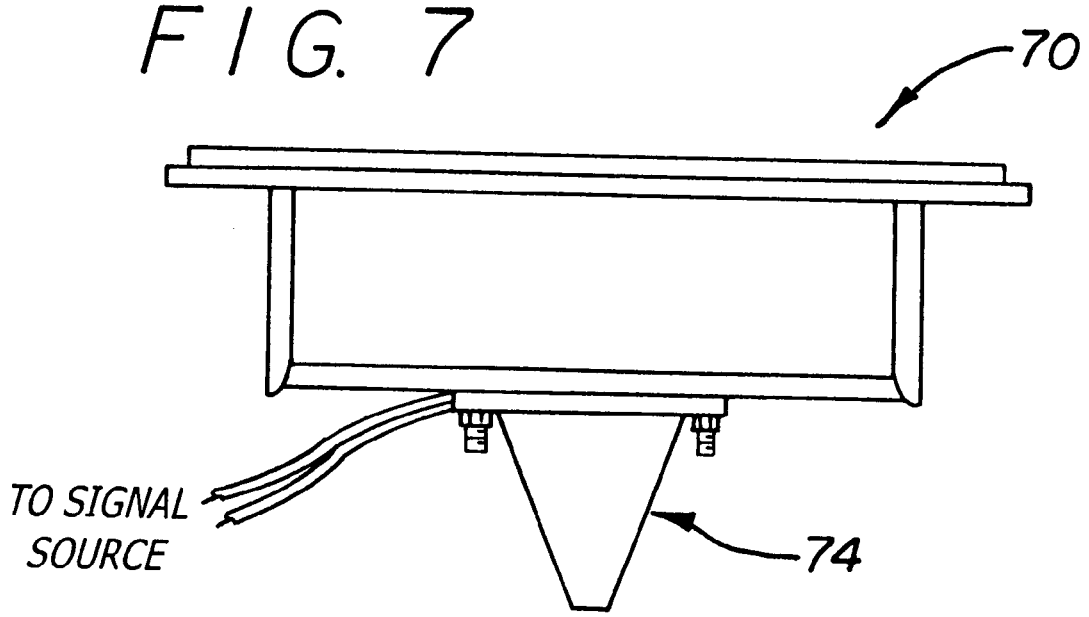
FIG. 7 is a vertical sectional view taken along plane 7—7 of FIG. 6, showing the thermal insulating cup and signal source leads.

Now referring to FIGS. 6 and 7, another embodiment 70 of the present invention includes a plurality of ventilation slots 72 formed in the back plate 16, offset from and surrounding the audio speaker 12 for communicating an air flow between the front grill 18 and the back plate 16 of the speaker arrangement 70, thereby allowing for the unimpeded operation of the ventilation system for those audio speaker arrangements 70 which are to be installed in operative air ducts. Although two sets of three ventilation slots 72 are shown in FIG. 6, it will be apparent to the skilled artisan that variations in the quantity, size, and placement of the slots may affect airflow through and around the speaker arrangement 70. So as to provide thermal protection for sensitive components of the audio speaker 12, an insulating device 74 such as a cup-shaped or cone-shaped thermal barrier is installed with the fasteners 36, 39 over the rearward extending speaker components to thermally isolate those components from conditioned, heated and cooled air either being flowed into or out of the room through the ventilation register of this embodiment 70. The insulating device 74 is configured to fully encompass the rearward extending speaker components with a relatively smooth preferably non-turbulence generating outer profile, and by so doing, providing a relatively unencumbered flow path for the conditioned air flow adjacent the back portion of the this embodiment.

Again referring to FIG. 8, another embodiment 80 of the present invention includes a remote transmitter (not shown) for transmitting audio signals to be received by a radio receiver powered by an adjacent d.c. source proximate the audio speaker 82 for receiving a signal from a remotely located signal source. According to this embodiment, the radio receiver and d.c. power source are contained either within the ventilation register 84 or at the back plate 86 of the register, either internally or externally, to maintain a compact assembly configured to be installed without alteration to the supporting structure or the ductwork. In addition, the invention contemplates the integration of a volume controller positioned adjacent the audio speaker, either within the cavity of the ventilation register or separately installed through the trim plate of the register. In like manner, a power control switch (not shown) may be provided to break the circuit during non-use of the system 80. As with the embodiment shown in FIGS. 6 and 7, a plurality of ventilation slots are formed in the back plate 86, offset from and surrounding the audio speaker 82 for communicating an air flow between the front grill and the back plate 86 of the speaker arrangement 80, thereby allowing for the unimpeded operation of the ventilation system for those audio speaker arrangements 80 which are to be installed in operative air ducts.

Although certain presently preferred embodiments of the invention have been described herein, it will be apparent to those skilled in the art to which the invention pertains that variations and modifications of the described embodiments may be made without departing from the spirit and scope of the invention.

I claim:

1. An audio speaker arrangement comprising:

an audio speaker;

a ventilation register to which the audio speaker is secured, the ventilation register having a front face through which sound generated by the audio speaker is projected, the ventilation register including a back plate spaced apart from the front face by a sidewall to form an enclosure adapted to be received in registration with a terminus of a ventilation duct; and a front trim plate secured by the sidewall, for engaging in overlapping relationship the speaker arrangement with a facing structure through which the speaker arrangement extends;

wherein the trim plate supports a plurality of louvers and the back plate includes at least one ventilation means offset from the audio speaker for communicating an air flow between the louvers and back plate of the speaker arrangement.

2. The audio speaker of claim 1, wherein the ventilation register is mountable in an in situ or pseudo arrangement with a ventilation system.

3. The audio speaker arrangement of claim 1, further comprising an insulating means encompassing a substantial portion of the audio speaker extending rearwardly from the back plate.

4. The audio speaker arrangement of claim 3, wherein the insulating means includes thermal insulating and sound insulating characteristics.

* * * * *